US005462171A

United States Patent [19]

Moog et al.

[11] Patent Number: 5,462,171

[45] Date of Patent: Oct. 31, 1995

[54] SHOCK-ABSORBING PACKAGE

[75] Inventors: John F. Moog, St. Louis County; Buford R. Strauser, St. Charles County, both of Mo.

[73] Assignee: The Timken Company, Canton, Ohio

[21] Appl. No.: 210,623

[22] Filed: Mar. 18, 1994

[51] Int. Cl.[6] ..... B65D 81/02

[52] U.S. Cl. ..... 206/592; 206/588; 206/594

[58] Field of Search ..... 206/523, 588, 206/590, 591, 592, 593, 594

[56] References Cited

U.S. PATENT DOCUMENTS

| | | | |
|---|---|---|---|
| 1,156,074 | 10/1915 | Hahn | 206/594 |
| 1,850,714 | 3/1932 | Gaylord | 206/594 |
| 2,728,479 | 12/1955 | Wheeler | 206/591 |
| 2,947,459 | 8/1960 | Pregent | 206/591 |
| 4,314,638 | 2/1982 | Gordon et al. | 206/594 |
| 4,474,293 | 10/1984 | Osborne | 206/592 |
| 4,998,619 | 3/1991 | Sowa et al. | 206/597 |

*Primary Examiner*—David T. Fidei

*Attorney, Agent, or Firm*—Polster, Lieder, Woodruff & Lucchesi

[57] ABSTRACT

A package for protecting objects, such as cans of hazardous material, during shipment includes a box and inserts located at opposite ends of the box. Each insert includes a pad of honeycomb and a wrap surrounding the pad. The pad along one of its facer sheets is cut to define a region where the honeycomb is crushed and the facer sheet is depressed so as to provide a pocket in the pad. The wrap for that insert has an opening which aligns with the pocket. The ends of the object fit through the openings in the wraps and into the pockets of the pads. Thus, the crushed honeycomb of the pads serves as cushions which confine the object axially within the box, whereas the wraps confine the object laterally within the box. The pads extend into the corners of the box, but the wraps do not, so that impacts delivered to the corners are absorbed by the pads and are not transmitted through the wraps.

14 Claims, 3 Drawing Sheets

SHOCK-ABSORBING PACKAGE

BACKGROUND OF THE INVENTION

This invention relates in general to packaging and more particularly to a shock-absorbing package suitable for hazardous materials and fragile objects.

Certain chemicals, because of their corrosive or other characteristics, are deemed hazardous, and as such require protective measures when shipped. The danger always exists that the containers for these substances, whether they be liquid or granular, will rupture or open as a consequence of the jolts and impacts typically encountered in transit. For example, many corrosive substances are sold in one gallon cans with friction fitted lids—the typical paint can. While this can will accept a moderate amount of abuse without opening or rupturing, it has its limits, and one would not want to entrust it to a delivery service—at least when it contains a hazardous material—without some extra measure of protection.

That extra protection today often takes the form of a corrugated paperboard carton and inserts of expanded resin which fit into the container and are provided with pockets that are large enough to receive the ends of the can. Thus, the inserts capture the can and its ends and isolate it from the walls of the carton. Being soft, the inserts absorb shocks that might otherwise be transmitted to the can during handling. On the other hand, the can may simply be immersed in expanded resin fragments within the carton, and these fragments cushion it during transit.

Once the package has served its purpose, the recipient usually discards it. Corrugated paperboard presents few problems in this regard because it readily decomposes in landfills or is easily incinerated without producing harmful products of combustion. The same cannot be said of the synthetic resins.

By the same token, fragile objects require an extra measure of precaution when shipped, lest they will fracture or otherwise incur damage as a consequence of the impacts typically encountered in transit.

The present invention resides in a package for holding a rigid object, and this package includes inserts made in part from paper honeycomb material. These inserts confine the object within the package and further absorb impacts. Moreover, they are environmentally sound and inexpensive to produce.

Description of the Drawings In the accompanying drawings which form part of the specification and wherein like numerals and letters refer to like parts wherever they occur:

DETAILED DESCRIPTION

Figure 1:
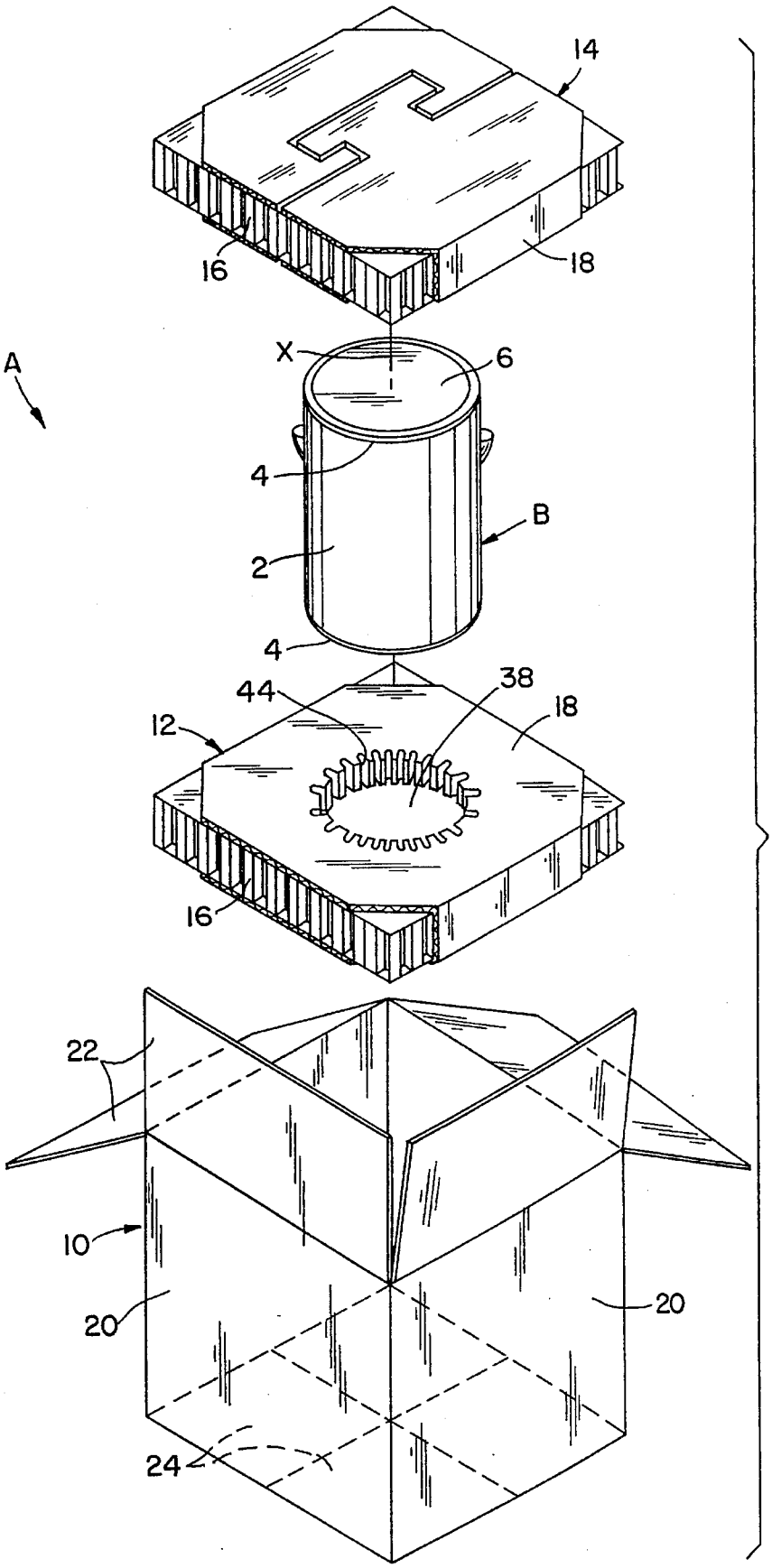
FIG. 1 is an exploded perspective view of the package and further showing a can of the type typically protected in the package.

Referring now to the drawings a package A (FIGS. 1 & 2) holds a rigid object, such as a can B which may contain a hazardous material—hazardous in the sense that is perhaps corrosive or mildly toxic. The material may exist as a liquid or gel or a solid, such as granular. The can B may be nothing more than a typical paint can, it having a cylindrical body 2 provided with chimes 4 at its ends and a circular lid 6 which is held in one end of the body 2 under a friction fit. Of course, the can body 2 and lid 6 should be formed from a substance that is inert to the material in the can. Usually this substance is nothing more than sheet steel plated with tin. The chimes 4 project radially a slight distance from the cylindrical surface of the body 2. The package A confines the can B both laterally and longitudinally and further absorbs impacts to which the package A may be subjected, thus isolating the can B from much of the abuse that it might otherwise encounter.

The package A includes (FIGS. 1 & 2) a box 10 which is somewhat larger than the can B, both in width and length, and inserts 12 and 14 which fit into the box 10 at its ends and receive the ends of the can B to thereby confine the can B to a centered position within the box 10. The box 10 is preferably formed from corrugated paperboard. Each insert 12 and 14 represents a composite of a pad 16 and a wrap 18 which fits around the pad 16, the former being formed from paper honeycomb material and the latter from corrugated paperboard. The pads 12 and 14, while fitting easily into the interior of the box 10, occupy the entire cross section of the ends of the box 10 and thus will not shift laterally in the box 10.

Turning now to the box 10, it is formed from corrugated paperboard in the traditional eight-cornered configuration with a rectangular cross section. As such it includes four side walls 20 arranged around and parallel to the box axis x in a tubular configuration and upper and lower end flaps 22 and 24 extended from the upper and lower margins, respectively, of the side walls 20. The lower end flaps 24 overlap and at least two are attached by tape or glue to form a closed end or bottom wall which retains the side walls 20 in the tubular configuration. The upper end flaps 22 initially remain detached from each other to provide access to the interior of the box 10, but in the completed package A they overlap and are likewise attached to one another to form another closed end or top wall.

The interior of the box 10 is preferably square in cross section by reason of the side walls 20 being of equal width. That width should exceed the diameter of the can B. The height of the side walls 20 should exceed the length, that is the axial dimension, of the can B.

Figure 5:
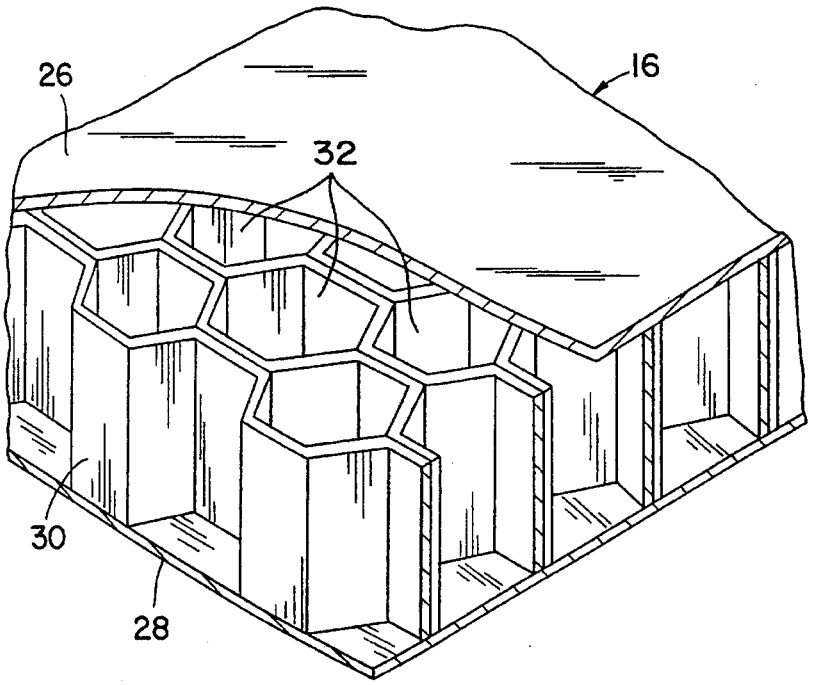
FIG. 5 is a fragmentary perspective view of the pad for one of the inserts.

The pad 16 of each insert 12 and 14 consists of (FIGS. 3 & 5) nothing more than a block of paper honeycomb that is large enough to fit somewhat snugly into the wrap 18. This block has paper facer sheets 26 and 28 which lie parallel to each other and intervening paper honeycomb located between the facer sheets 26 and 28. Indeed, the intervening honeycomb 30 along its end margins is attached to the facer sheets 26 and 28 with glue. The honeycomb 30 creates a multitude of hexagonal honeycomb cells 32 which lie parallel to each other with their axes perpendicular to the facer sheets 26 and 28. Indeed, the pad 16 is cut from a large block paper honeycomb material which is available commercially.

Figure 2:
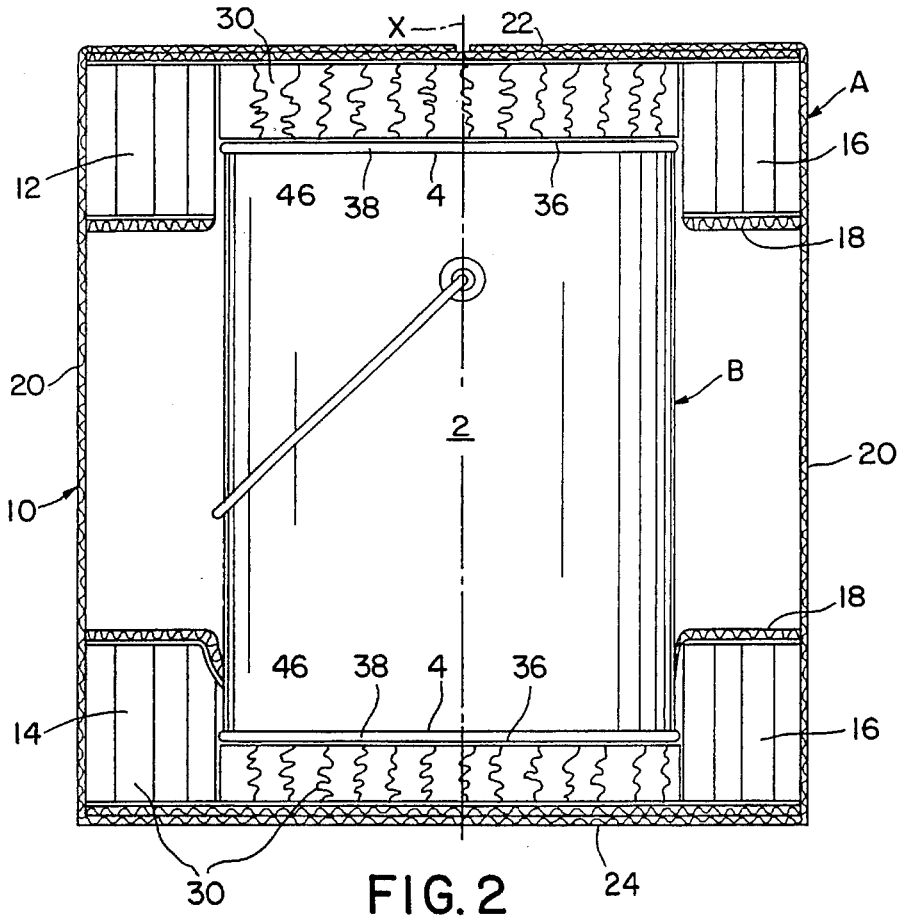
FIG. 2 is a sectional view in elevation of the package with the can in the package.

Paper honeycomb material possesses considerable compressive strength in the direction of the axes of its cells 32, but if enough compressive force is applied in that direction the intervening honeycomb 30 will collapse. Even when collapsed the intervening honeycomb 30 will still withstand substantial compressive forces, but in a manner such that it yields much like a cushion. Indeed, each pad 16 contains a circular cut 34 which extends through its facer sheet 26 and well into the intervening honeycomb paper 30, with the circle so formed having its center at the center of the pad 16 and its diameter slightly larger than the chimes 4 at the end of the can body 2. The cut 34 leaves within the facer sheet 26 a circular region 36 which is thereafter driven downwardly toward the other facer sheet 28 with enough force to crush the intervening honeycomb 30 and thereby obliterate the cells 32 in that region (FIG. 2). In other words, the circular region 36 is displaced from the remainder of the facer sheet 26, thus providing the pad 16 with a circular pocket 38, the base of which is the depressed circular region region 36 of the facer sheet 26. The cut 34 and pocket 38 may be formed with a punch which is driven into a uniform block of honeycomb, the punch having a circular cutting edge which projects axially slightly beyond its flat bottom surface which of course is equal in size to the region 36. The punch drives the circular region 36 downwardly, and there it remains. Thus, the crushed honeycomb 30 exists at an elevation less than the remaining honeycomb 30, and thereby creates the pocket 38.

The crushed paper honeycomb 30 serves as a cushion, enabling the depressed region 36 of the facer sheet 26 yield somewhat elastically when a further load is applied to it. The pockets 38 of the pads 16 for the two inserts 12 and 14 receive the ends of the can B so that the crushed honeycomb 30 behind those pockets 38 serves to absorb impacts which are transmitted axially into the box 10.

While the two pads 16 provide good buffers for axially directed forces, they are not nearly as effective in resisting lateral forces, that is to say forces which are directed radially with respect to the can B, this being by reason of the relative weakness of the honeycomb 30 in lateral directions. The wraps 18, which fit snugly into the interior of the box 10, provide the lateral strength.

Each wrap 18 is formed from a strip or elongated section of corrugated paper, with the corrugations extending longitudinally of the strip. The wrap 18 includes (FIGS. 3 & 4) five panels joined together along fold lines 40. In particular, the wrap 18 includes a center panel 42 having essentially the same dimensions as the pad 16, except that its corners are removed or clipped to give panel 42 an octagonal shape. In addition, the center panel 42 has a generally circular opening 44, the margin of which is interrupted by fingers 46 which are initially directed radially inwardly. The opening 44 has about the same diameter as the circular cut 34 in the facer sheet 26 of the pad 16, at least when fingers 46 which lie along it are ignored. The fingers 46 project inwardly into the opening 44 and are further turned generally axially so as to project beyond the plane of the panel 42. Two of the folds 40 in the wrap 18 lie at opposite sides of the center panel 42, and along these folds 40 side panels 48 are attached to the center panel 42. Since the corners of the center panel 42 are clipped, the side panels 48 are not nearly as wide as the center panel 42, nor the pad 16. The remaining folds 40 lie along the opposite margins of the side panels 48. One side panel 48 along its other fold line 40 is connected to an end panel 50 having a T-shaped cutout 52. The other side panel 48 along its opposite fold 40 connects with another end panel 54 having a T-shaped tab 56 projected from its end, with the tab 56 being configured to fit into the cutout 52 in the end panel 50. Each of the two end panels 50 and 54 is as wide as the center panel 42, and like the center panel 42 they have clipped corners to accommodate the lesser width of the side panels 48. The combined length of the two end panels 50 and 54 equals the length of the center panel 42.

Figure 3:
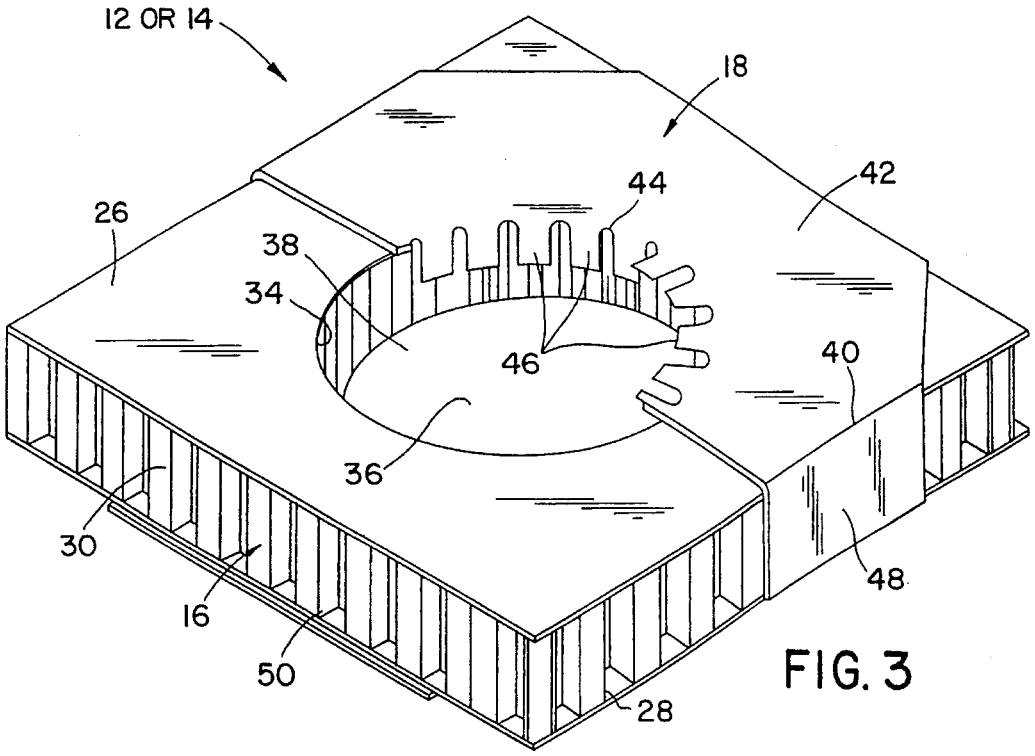
FIG. 3 is a perspective view, partially broken away and in section, of one of the inserts that comprises the package.
Figure 4:
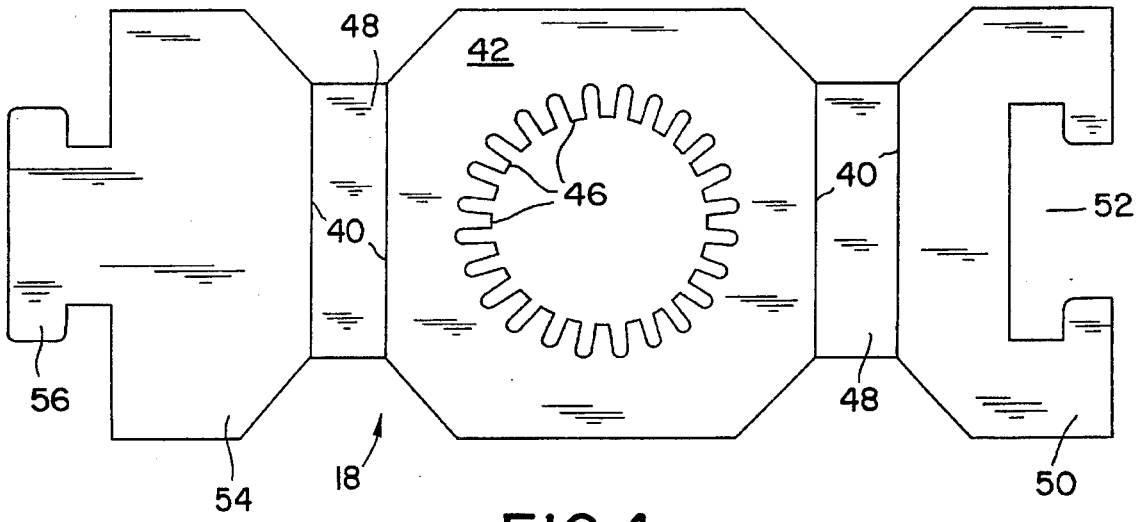
FIG. 4 is a plan view of the wrap for one of the inserts, with the wrap being in an open condition.

The wrap 18 folds around the pad 16 of the insert 12 or 14, of which it is a component, with the center panel 42 overlying the front facer sheet 26 of the pad 16, the side panels 48 located along the honeycomb cells 32 at the sides of the pad 16, and the two end panels 50 overlying the back facer sheet 28 (FIG. 3). The circular opening 44 in the center panel 42 aligns with the pocket 38 in the pad 16, and indeed the margin of the opening 44, that is the margin from which the fingers 46 project, generally registers with the circular cut 34 in the facer sheet 26. The fingers 46 project inwardly slightly and turn axially into the pocket 38. Even when given a true axial orientation, the fingers 46 do not reach the depressed circular region 36 that forms the base of the pocket 38. The tab 56 on the end panel 54 fits into the cutout in the end panel 50, and owing to the complementary T-shaped cofigurations of the tab 56 and cutout 52, the two end panels 50 nd 54 lie in the same plane (FIG. 1). Indeed, the end panels 50 and 54 interlock and cannot be separated or pushed over each other while they remain in a common plane. The clipped corners on the center panel 42 and the two end panels 50 and 54 expose the corners of the pad 16, inasmuch as those corners have a right angle configuration (FIGS. 1 & 3). In other words, the corners of the pad 16 project beyond the clipped corners of the panels 42, 50 and 54 of the wrap 18.

While the crushed honeycomb 30 beneath the pocket 38 in the pad 16 provides the insert 12 or 14 of which it is a component with a cushioning, yet force resisting, capacity in the axial direction, the panels 42, 50 and 54 give the insert 12 or 14 lateral strength and thereby enable it to resist lateral forces. Yet the exposed corners of the pad 16 offer a measure of cushioning laterally, at least as to forces that are directed inwardly from corners as most will be.

When the two inserts 12 and 14 are fitted to the can B with the ends of the can received in the pockets 38 of the pads 16 for those inserts 12 and 14, the distance between the planes occupied by the end panels 50 and 54 of the wraps 18 for the two inserts 12 and 14 will be about equal to the axial dimension of the box 10 (FIG. 2).

One desiring to provide the can B with a good measure of protection during shipment or even storage will place the can B in the package A to there confine it. To this end, the box 10 is erected, if it is not already in an erected condition. This involves bringing its side walls 20 into a tubular configuration, folding the lower flaps 24 over upon each other and attaching them together and perhaps to two of the side walls 20 as well to maintain the tubular configuration and provide a bottom wall. Next the lower insert 12 is placed in the box 10 with its end panels 50 and 54 interlocked and against the bottom wall of the box 10 where they remain in a common plane. Hence, the pocket 38 in the pad 16 opens upwardly through the circular opening 44 in the wrap 18 so that the pocket 38 is exposed. Next the can B is lowered into the box 10 and its lower end is forced against the fingers 46 which project into the opening 44 of the wrap 18. The chime 4 at the lower end of the cylindrical can body 2 deflects the fingers 46 axially and the lower end descends into the pocket 38, coming against the circular region 36 at the base of the pocket 38. By this time the chime 4 at the lower end of the can body 2 lies below the fingers 46 along the circular cutout 44. Indeed, the fingers 46 snap inwardly against the cylindrical wall of the can body 2 and in effect engage the can B with the insert 12 so that the two are not easily separated. Thereupon, the upper insert 14, with its pocket 38 presented downwardly, is inserted into the upper end of the box 10. The pocket 38 of this insert receives the upper end of the can body 2, the fingers 46 around the cutout 44 in its wrap 18 deflecting as they pass over the chime 4 which surrounds the lid 6 of the can B. The circular region 36 at the base of the pocket 38 comes against the lid 6 and as it does, the chime 4 that is around the lid 6 clears the fingers 46 and they snap behind the chime 4 and against the cylindrical side wall of the can body 2, thus engaging the insert 14 with the upper end of the can B. With the insert 14 so disposed, the interlocked end panels 50 and 54 for the wrap 18 of the insert 14 lie flush with the upper margins of the side walls 20 for the box 10. Finally, the end flaps 22 at the upper end of the box 10 are folded over onto each other and are attached to each other with glue or perhaps to two of the side walls 20 with tape to form an upper end wall on the box 10.

The folded and secured end panels 50 and 54 of the box 10 hold the inserts 12 and 14 in place with the can B captured between the depressed circular regions 36 on the pads 16 of the two inserts 12 and 14. The crushed paper honeycomb 30 lies behind circular regions 36 to provide cushions at the ends of the can B. Should the package A upon being dropped come to rest on either of its ends, that is on the end flaps 22 or 24 at either end of the box 10, the crushed honeycomb 30 of the pad 16 at that end will absorb much of the impact and prevent it from being transmitted to the can B.

The wraps 18 of the two inserts 12 and 14, on the other hand, confine the can B laterally and thus maintain it centered between the side walls 20 of the box 10. Being centered, the can B is spaced from the side walls 20 of the box 10 and as such is less likely to be punctured. In other words, the side walls 20 of the box 10 protect the cylindrical wall of the can body 2 from impacts and puncture. The exposed corners of the pads 16 for the two inserts 12 and 14 lie within the corners of the box 10. Should the box 10 be dropped, it would stand a good chance of landing on one of its corners. Being detached from their respective wraps 18 at these corners the pads 16 at these regions will function as cushions for absorbing impacts directed at the corners. In other words, the honeycomb paper 30 and facer sheets 26 and 28 at any corner of a pad 16 to which an impact is directed will cave in and crumble and in so doing absorb much of the impact.

While the package A depicted and described in detail holds and protects a can B containing a hazardous material, with minor modifications, primarily in the configuration of the pockets 38 and openings 44 in the two inserts 12 and 14, it may be used to hold other types of containers and also fragile objects which will sustain damage if subjected to the typical impacts encountered in transit.

Plastic locking rings exist for rendering cans with friction fitted lids more secure, and the can B will accept such a ring. The typical ring snaps over the chime 4 around the upper end of the cylindrical body 2 and overlies the peripheral region of the lid 6. As such, the locking ring supplements the friction fit, and the lid 6 is less likely to be dislodged. The fingers 46 which surround the entrance to the pocket 38 in the upper insert 14 are set deeply enough in the panel 42 to accommodate a locking ring, allowing it to pass through the panel 42, and the pocket 38 is large enough to receive the ring.

This invention is intended to cover all changes and modifications of the example of the invention herein chosen for purposes of the disclosure which do not constitute departures from the spirit and scope of the invention.

What is claimed is:

1. A package for protecting a rigid object, said package comprising a box having an axial directed space defined by side walls and opposite ends spaced apart in the axial direction of said side walls, with one end of said box open to receive the rigid object; an object supporting insert at one end of said box, the insert including a pad containing honeycomb cells with cell axes parallel to the axial direction of said side walls and providing a region of crushed honeycombs providing within the pad to form a pocket which opens to receive and cushion the rigid object; a wrap comprising a panel extending over the pad and being formed with an opening aligned with said region of crushed honeycomb such that the wrap will support the rigid object laterally, the pad being of polygonal configuration and the panel extending out to the sides of the pad, and the corners of the pad projecting beyond the panel so impacts directed at the corners of the pad will collapse the honeycomb of the pad and the impact will be absorbed.

2. A package according to claim 1 wherein the pad is rectangular and the wrap panel is octagonal.

3. A package according to claim 1 wherein the wrap extends around the pad.

4. A package according to claim 1 wherein said pad has front and back facer sheets and the wrap extends around the pad and includes a center panel which contains the opening that aligns with the pocket in the pad, and side panels which are connected to the center panel and lie along the sides of the pad where they are parallel to the axes of the honeycomb cells, and at least one end panel which is attached to one of the side panels and extends along the back facer sheet surface of the pad.

5. A package according to claim 4 wherein the wrap also includes a first end panel attached to one of the side panels and a second end panel attached to the other side panel, the two end panels extending substantially the full width of the pad and being connected so as to enable the insert to better withstand forces applied laterally to the honeycomb cells.

6. A package according to claim 5 wherein the end panels interlock.

7. A package for holding and protecting a rigid object, said package comprising: a box having side walls which are arranged around an axis and enclose a hollow interior and end walls which close the ends of said interior, a first insert located within the interior of the box at one end thereof; and a second insert located within the interior of the box at the other end thereof, each insert being configured to extend between the sidewalls of the box such that the rigid object will not shift laterally within the box, each insert including a pad which is formed from a honeycomb having cells and first and second facer sheets overlying the ends of the honeycomb, the first facer sheet being cut along a line which defines a depressible region where the first facer sheet is depressed from the remainder of the first facer sheet to form a pocket and where the honeycomb underlying the depressible region is crushed sufficiently to serve as a cushion, whereby the said cut line defines a margin of said pocket which opens out of the pad toward the opposite insert, each insert also including a wrap which extends over the first facet sheet and likewise extends between the walls of the box, so that said wrap will not shift laterally in the box, the wrap having an opening which aligns with the margin of said pocket in the pad for the insert, the pockets of the pads being configured to snugly receive the rigid object so that the pads will confine the rigid object axially and the wraps will confine the object laterally.

8. A package according to claim 7 wherein the sidewalls of the box meet at corners and the pads extend into the corners, but the wraps do not, so that the portions of the pad which lie adjacent the corners are exposed to collapse under impacts delivered to the corners of the box and thereby absorb such impacts.

9. A package according to claim 7 wherein the wrap of each insert extends around the pad of the insert, such extension being along the first and second facer sheets and two sides of the pad.

10. A package according to claim 7 wherein the wrap of each insert along the margin of its opening has fingers which project toward the center of the opening and are deflected into the pocket of the pad for the insert so as to engage the rigid object received in the opening and pocket.

11. The package of claim 8 in combination with a rigid object having ends which are received in the openings of the wrap and in the pockets of the pads for the inserts.

12. The combination according to claim 11 wherein the object is a can of cylindrical configuration.

13. The combination according to claim 12 wherein the can has at its ends radially outwardly directed chimes; wherein the wrap of each insert has fingers along the margin of its opening; and wherein the fingers are deflected into the pocket of the pad for the insert such that the fingers lie behind the chimes of the can.

14. A package for protecting a rigid object against shipping damage comprising: a shipping box having side walls enclosing a space for the rigid object; blocks of honeycomb cellular material in which the cells are axially parallel with the shipping box side walls, the blocks of cellular material being fitted in the shipping box to absorb axial movement, the blocks of honeycomb cellular material having enclosing facer sheets secured to the honeycomb cellular material over the axial ends of the cells; pockets formed in the blocks of honeycomb cellular material defined by cut lines in one of the facer sheets, the cellular material within the cut lines being crushed to form the pockets for the rigid object; and wrap carried by the blocks of honeycomb cellular material over the facer sheets and having an opening which aligns with the pocket to receive the rigid object and to provide strength against forces directed laterally of the rigid object.

* * * * *

UNITED STATES PATENT AND TRADEMARK OFFICE

CERTIFICATE OF CORRECTION

PATENT NO. : 5,462,171

DATED : October 31, 1995

INVENTOR(S) : John F. Moog, Buford R. Strauser

It is certified that error appears in the above-indentified patent and that said Letters Patent is hereby corrected as shown below:

On the title page, item [73] "Assignee" delete

"The Timken Company, Canton, Ohio" and insert ---Innovative Enterprises, Inc., Washington, Missouri"---

Col. 3, line 13 - delete "region"

Signed and Sealed this

Third Day of September, 1996

*Attest:*

*Attesting Officer*

BRUCE LEHMAN

*Commissioner of Patents and Trademarks*